United States Patent [19]

Bourrian

[11] 4,133,463

[45] Jan. 9, 1979

[54] SHIRT COLLAR SUPPORT

[76] Inventor: Isaac Bourrian, Teniente Benjamin Matienzo 1645, Buenos Aires, Argentina

[21] Appl. No.: 861,441

[22] Filed: Dec. 15, 1977

[30] Foreign Application Priority Data

Dec. 20, 1976 [AR] Argentina ..... 265924

[51] Int. Cl.[2] ..... D06C 15/00

[52] U.S. Cl. ..... 223/83

[58] Field of Search ..... 223/66, 71, 81, 83, 223/84; 2/132, 138

[56] References Cited

U.S. PATENT DOCUMENTS

| | | | |
|---|---|---|---|
| 2,257,922 | 10/1941 | Wilson | 223/71 |
| 2,338,211 | 1/1944 | Steele | 223/83 |
| 2,560,710 | 7/1951 | Akers | 223/71 |
| 2,719,657 | 10/1955 | Allen et al. | 223/84 |
| 3,072,306 | 1/1963 | Macrides | 223/84 |

FOREIGN PATENT DOCUMENTS

| | | | |
|---|---|---|---|
| 926166 | 5/1963 | United Kingdom | 223/83 |

*Primary Examiner*—Henry Jaudon

*Attorney, Agent, or Firm*—Emory L. Groff, Jr.

[57] ABSTRACT

The invention relates to a support member for shirt collars to be used during storage and display of the shirt. The support member is formed from a strip of pliable plastic material by a stamping process, for example, and includes free ends, a medial portion and a pair of spaced apart corrugated portions between said free ends and said medial portion. The corrugated portions provide hinge points to facilitate bending the strip into the desired shape to fit between the neckband of the collar and the outer downwardly folded portion thereof so as to maintain the collar in an upright position. The upper portions of each of the free ends of the strip are bent inwardly along lines defined by a longitudinally extending rib on each free end. Oppositely disposed pairs of transverse ribs are also provided in the free ends of the support member and intersect the longitudinal ribs.

4 Claims, 5 Drawing Figures

SHIRT COLLAR SUPPORT

The present invention relates to a support member for keeping shirt collars in an upright position when the shirt is packaged and displayed for sale.

It is now a common practice, when shirts are folded and put in plastic bags or boxes for storage and sale, to place between the collar and the shirt, a cardboard or Bristol board strip having approximately the same shape as the collar. Also, pieces of shaped plastic material may be placed under the collar tips, in order to keep them upright and to provide a better appearance.

The cardboard or Bristol board strips now commonly in use are frequently bent or twisted during handling thus, wrinkling the shirt collar. The aforementioned pieces of plastic material have a tendency to become displaced resulting in an unsightly appearance of the collar, which is undesirable from the standpoint of the salability of the shirt.

The object of this invention is to overcome such disadvantages and provide an improved support member for insertion beneath the shirt collar at the completion of the manufacturing operation. The support member may be stamped or molded from a plastic or like material and be provided with ribs and corrugated portions which permit obtaining and maintaining a particular shape for support of the shirt collar while the shirt is stored in a shipping container and during the time when it is displayed in a store for sale.

With this and other objects in view which will more readily appear as the nature of the invention is understood, the same consists in the novel construction, combination and arrangement of parts hereinafter more fully described, illustrated and claimed.

A preferred and practical embodiment of the invention is shown in the accompanying drawing in which.

Similar reference characters designate similar parts throughout the various figures of the drawing.

Figure 1:
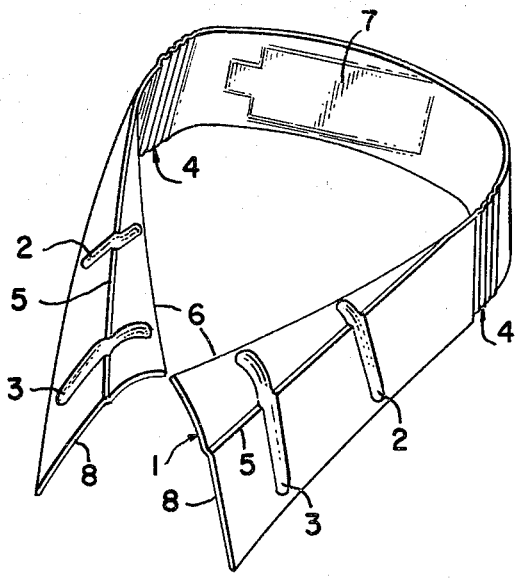
FIG. 1 is a perspective view of the collar supporting member according to this invention in its position of use.
Figure 2:
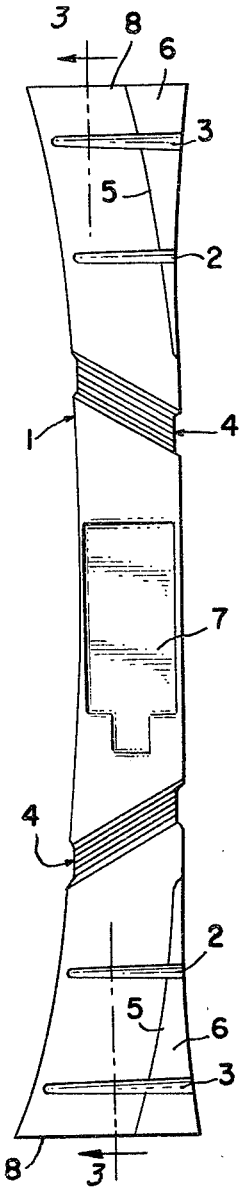
FIG. 2 is a top plan view of the collar supporting member of FIG. 1 in a flattened position.
Figure 3:
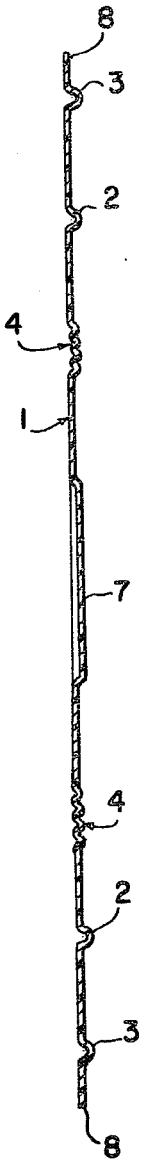
FIG. 3 is a cross-section along the line 3—3 of FIG. 2, of the collar supporting member which shows more clearly the ribs and corrugated portions formed in said member.
Figure 4:
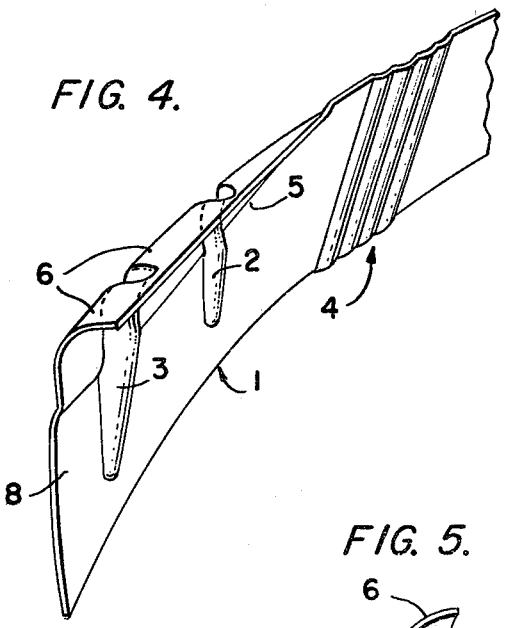
FIG. 4 is a fragmentary perspective view on an enlarged scale of a portion of the collar supporting member showing the inner side thereof with the ribs more clearly shown.
Figure 5:
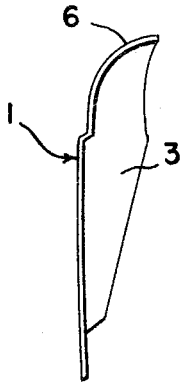
FIG. 5 is a fragmentary front view partly in section, showing one of the front ribs.

As shown in FIGS. 1 and 2, the collar supporting member 1 is formed from a strip of pliable plastic material or celluloid and is shaped to conform substantially to the configuration of the shirt collar it will support. At each end of the supporting member 1 toward the tips 8 thereof, there are corresponding pairs of ribs 2 and 3 of generally U-shape in cross-section which project inwardly as best seen in FIGS. 3 and 4. These ribs maintain the front portions of the member in an upwardly and inwardly bent shape which keeps the shirt collar spaced from the remainder of the shirt in an upright position.

Said supporting member has, in zones located rearwardly of the ribs 2 and 3, corrugated portions 4, which provide hinge means for greater flexibility during the folding of the strip and permit its insertion beneath the shirt collar without danger of the strip breaking at the points where it is folded which occurs with known supports of the prior art. The ribs 2 and 3 being formed on the inside of the strip provide it with rigidity and serve as bearing points for the neck band of the collar. The ribs 4 are inclined relative to the longitudinal edges of the strip as shown in FIG. 2 to provide the proper slope to the support when in use.

In the front upper portions of the support member 1 reinforcement ribs 5 are provided which extend longitudinally from each of the tips 8 rearwardly to a point close to the corrugated portions 4 and define the lower limits of the inwardly curved portions 6 of the support member. Said curved portions are so disposed as to provide improved support for the adjacent areas of the shirt collar when the support is in use.

At the rear of the support member between the corrugated portions 4, a raised area 7 is formed to provide both greater rigidity for the strip and a convenient place for a trademark, shirt size or other information.

From the foregoing, it is believed that the construction and advantages of the herein described improvement will be apparent without further description and it will also be understood from the various figures of the drawings that changes in the form and minor details of the construction may be resorted to without departing from the spirit and scope of the invention and the appended claims.

I claim:

1. A support for a shirt collar for use during storage and display of the shirt, said support comprising an elongated pliable strip including free ends and a medial portion, spaced apart corrugated areas between said medial portion and said free ends, said corrugated areas defining hinge points between said medial portion and said free ends to facilitate bending the latter toward one another and into the desired position to support said collar, said corrugated areas being inclined relative to the longitudinal edges of said strip, said longitudinal edges being parallel to each other between said corrugated areas and diverging relative to each other from a point adjacent said corrugated areas to the tips of the free ends of the strip, and reinforcing means between said corrugated areas and the tips of said free ends.

2. A support for a shirt collar according to claim 1 wherein said reinforcing means includes a rib extending longitudinally from each of the tips of the free ends of said strip toward said corrugated portions, each said rib diverging from the adjacent longitudinal edge, the area formed between said rib and said adjacent longitudinal edge being bent inwardly into an arcuate shape to provide an increased supporting surface for the front portions of the shirt collar.

3. A support for a shirt collar according to claim 2 wherein said reinforcing means further includes ribs of generally U-shape in cross-section extending transversely of said strip between said free ends and said corrugated areas, generally U-shaped ribs intersecting said longitudinally extending ribs and projecting into said inwardly bent areas.

4. A support for a shirt collar according to claim 3 wherein the medial portion of said strip includes a raised area on one face thereof, said raised area providing increased rigidity for said medial portion of the strip and also providing an indicia bearing space for information relating to the shirt with which the collar support is used.

* * * * *